US009951728B2

(12) United States Patent
Ostler et al.

(10) Patent No.: US 9,951,728 B2
(45) Date of Patent: Apr. 24, 2018

(54) ACOUSTIC ATTENUATOR FOR AN ENGINE BOOSTER

(71) Applicant: Ford Global Technologies, LLC, Dearborn, MI (US)

(72) Inventors: Will Ostler, Maidstone (GB); Robert Andrew Leeson, Stansted (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/711,564

(22) Filed: May 13, 2015

(65) Prior Publication Data

US 2015/0252759 A1 Sep. 10, 2015

(30) Foreign Application Priority Data

Oct. 12, 2011 (GB) ..... 1117577.5

(51) Int. Cl.

| | |
|---|---|
| ***F02M 35/12*** | (2006.01) |
| ***F01N 1/02*** | (2006.01) |
| ***F02M 35/10*** | (2006.01) |
| ***F01N 1/24*** | (2006.01) |
| ***F02M 35/00*** | (2006.01) |
| *F01N 1/00* | (2006.01) |

(52) U.S. Cl.

CPC ..... *F02M 35/1272* (2013.01); *F01N 1/24* (2013.01); *F02M 35/00* (2013.01); *F02M 35/10* (2013.01); *F02M 35/1211* (2013.01); *F02M 35/1216* (2013.01)

(58) Field of Classification Search

CPC ..... F02M 35/1272; F02M 35/1216; F02M 35/1227; F02M 35/1233; F02M 35/1255; F02M 35/1261; F02M 35/1266; F01N 1/026; F01N 1/04

USPC ..... 181/229, 250; 123/184.53, 184.57

See application file for complete search history.

(56) References Cited

U.S. PATENT DOCUMENTS 3,061,039 A * 10/1962 Peters ..... F16L 55/02 138/121

3,712,416 A 1/1973 Swanson et al.

(Continued)

FOREIGN PATENT DOCUMENTS

EP 1433948 A2 6/2004

GB 1534745 12/1976

(Continued)

OTHER PUBLICATIONS

Anonymous, "Built-in Silencers to Supress Defroster Noise—for Defrost and Floor modes," IPCOM No. 000141347, Published Oct. 4, 2006, 2 pages.

(Continued)

*Primary Examiner* — Edgardo San Martin

(74) *Attorney, Agent, or Firm* — Julia Voutyras; McCoy Russell LLP

(57) ABSTRACT

An acoustic attenuator 20 for an engine booster such as a turbocharger 10 for an engine 4 is disclosed in which the acoustic attenuator 20 includes an attenuator chamber 28 in which is located at least one absorption media 140. The acoustic attenuator 20 is located adjacent an inlet port of the turbocharger 10 so as to attenuate any acoustic pressure waves by dissipative reaction with the absorption media 140 before they have chance to reach other components of a low pressure supply system 50 for the engine 4.

14 Claims, 7 Drawing Sheets

(56) References Cited

U.S. PATENT DOCUMENTS 3,819,319 A 6/1974 Schreter
4,204,586 A 5/1980 Hani et al.
4,254,746 A * 3/1981 Chiba ..... F02M 35/1266 123/184.42
4,969,536 A * 11/1990 Allen ..... F02M 35/1216 181/225
5,417,727 A 5/1995 Bowen et al.
5,979,598 A 11/1999 Wolf et al.
5,992,560 A * 11/1999 Matsuoka ..... F01N 1/24 181/252
6,688,425 B2 2/2004 Cole et al.
6,722,467 B1 4/2004 Kusche et al.
6,752,240 B1 6/2004 Schlagenhaft
6,830,024 B2 * 12/2004 Kodweiss ..... F02B 75/243 123/184.53
6,851,514 B2 2/2005 Han et al.
7,017,706 B2 * 3/2006 Brown ..... F01D 25/30 181/222
7,107,959 B2 * 9/2006 Kino ..... F02M 35/1216 123/184.57
7,174,872 B2 * 2/2007 Kino ..... F02M 35/1216 123/184.57
7,198,017 B2 * 4/2007 Vogt ..... F02M 35/1283 123/184.57
7,207,310 B2 4/2007 Shaw et al.
7,584,821 B2 * 9/2009 Prior ..... F02M 35/1216 181/241
7,631,726 B2 12/2009 McWilliam et al.
7,766,731 B2 8/2010 Aschenbruck et al.
7,779,822 B2 * 8/2010 Prior ..... F02M 35/104 123/184.42
7,802,651 B2 * 9/2010 Park ..... B01D 46/10 181/224
7,934,581 B2 * 5/2011 Kim ..... F04D 29/665 123/184.53
8,177,024 B2 * 5/2012 Caliskan ..... F02M 35/10321 123/184.53
8,316,987 B2 * 11/2012 Ishida ..... F01N 1/04 181/229
8,327,975 B2 12/2012 Ortman et al.
8,485,311 B2 7/2013 Mackenzie et al.
8,617,454 B2 12/2013 Khami et al.
8,651,800 B2 * 2/2014 Li ..... F02M 35/10157 415/119
9,057,313 B2 * 6/2015 Heeb ..... F01N 13/00
9,097,220 B2 * 8/2015 Ostler ..... F02M 35/1216
9,175,648 B2 * 11/2015 Dobrin ..... F02M 35/1261
2002/0084138 A1 * 7/2002 Weinstein ..... E04F 17/04 181/268
2003/0072459 A1 4/2003 Cole et al.
2006/0032700 A1 2/2006 Vizanko
2007/0000467 A1 1/2007 Shaw et al.
2008/0056882 A1 3/2008 Clay et al.
2008/0210188 A1 9/2008 Koss
2008/0230306 A1 * 9/2008 Ichikawa ..... F02M 35/1272 181/229
2009/0241888 A1 10/2009 Koss
2009/0314241 A1 * 12/2009 Koss ..... F02M 35/1266 123/184.53
2010/0193282 A1 * 8/2010 Kim ..... F04D 29/665 181/229
2011/0299981 A1 12/2011 Li
2012/0222643 A1 9/2012 Jasnie et al.
2013/0092472 A1 4/2013 Ostler et al.
2014/0126997 A1 5/2014 Watson et al.

FOREIGN PATENT DOCUMENTS

GB 2365066 B * 1/2005 ..... F16L 55/033
GB 2490803 B * 5/2015 ..... F02M 35/0218
JP 63309762 A 12/1988
JP 2004150367 A 5/2004

OTHER PUBLICATIONS

Anonymous, "Enhanced Flow Control Airflow Register," IPCOM No. 000141357, Published Oct. 4, 2006, 2 pages.

* cited by examiner

ACOUSTIC ATTENUATOR FOR AN ENGINE BOOSTER

CROSS REFERENCE TO RELATED APPLICATIONS

This application is a divisional of U.S. patent application Ser. No. 13/645,378, entitled "AN ACOUSTIC ATTENUATOR FOR AN ENGINE BOOSTER," filed on Oct. 4, 2012, which claims priority to United Kingdom Patent Application Number 1117577.5, entitled "AN ACOUSTIC ATTENUATOR FOR AN ENGINE BOOSTER," filed on Oct. 12, 2011, the entire contents of each of which are hereby incorporated by reference for all purposes.

BACKGROUND/SUMMARY

The present application relates to the reduction of engine noise and, in particular, to an acoustic attenuator for an air compressor of an engine booster. In the case of a turbocharger engine during transient maneuvers, broadband aeroacoustic noises can be generated by the compressor dynamics. The acoustic pressure waves can propagate upstream of the compressor against the flow of air and be radiated via the various components forming a low pressure air supply for the turbocharger. In addition, when the pressure produced by the turbocharger exceeds a predetermined value in tip-out maneuvers, it is usual for a compressor bypass valve to open. The opening of this valve can generate broadband acoustic pressure waves in a backflow direction and an audible 'whoosh' noise that is radiated via the various components forming the low pressure air supply for the turbocharger.

U.S. Pat. No. 6,752,240 provides a reactive noise reducing device connected to an inlet of an air compressor of a supercharger for an engine. Such a device has the disadvantages that it is of relatively large size due to the need to provide a number of different chambers if different frequencies are to be silenced. This is because a specific chamber dimension is required to reduce specific frequency ranges. Such an arrangement is very inflexible in terms of operation and has to be designed to fit a specific supercharger installation. That is to say, if the same supercharger is used on a different engine requiring a different air inlet system design this type of noise reducing device may not provide adequate noise attenuation due to the different frequency ranges that may be produced.

Some embodiments described herein provide an attenuator for an engine booster that overcomes the problems referred to above. According to a first aspect, there is provided an acoustic attenuator for an engine booster comprising an attenuator body defining an air flow passage through which low pressure air flows to an air compressor of the booster and an attenuator chamber containing acoustic pressure wave absorbing material operatively connected to the air flow passage via a number of transfer ports wherein the acoustic attenuator is located close to an inlet port of the air compressor.

One end of the attenuator body is adapted for connection to an inlet port of the air compressor. The body may be adapted for direct connection to the inlet port of the air compressor or may be adapted for indirect connection by being connected via a short spacer component such as a tube. The attenuator chamber may extend around only a portion of the attenuator body. The portion may be an upper portion, in a vertical direction relative to a surface on which a wheel of the vehicle rests. Each of the transfer ports may be formed by an elongate aperture aligned with the general flow path of air through the air flow passage.

The acoustic pressure wave absorbing material may be one of a fibrous mat, foam and a combination of foam and a fibrous mat. The attenuator chamber may house at least two acoustic pressure wave absorbing materials having differing frequency absorbing properties. The attenuator chamber may be formed by a separate attenuator housing that fits in an aperture in the attenuator body. The attenuator housing may comprise first and second end walls, first and second side walls and a floor in which a number of apertures defining the transfer ports are formed and a cover securable to the attenuator so as to form a lid for the attenuator housing.

According to a second aspect, there is provided a low pressure air supply system for an engine having a booster, the system comprising a low pressure air inlet through which atmospheric air is drawn into the system, an air filter for filtering the air drawn in via the low pressure air inlet and a low pressure air conduit connecting the air filter to an inlet end of an acoustic attenuator constructed in accordance with said first aspect wherein the acoustic attenuator is located close to an inlet port of an air compressor of the booster.

The acoustic attenuator has an outlet end adapted for connection to an inlet port of an air compressor of the booster. The attenuator body may be adapted for direct connection to the inlet port of the air compressor or may be adapted for indirect connection by being connected via a short spacer component such as a tube.

According to a third aspect, there is provided a motor vehicle having an engine, a booster connected to the engine so as to provide a boosted air supply to the engine and a low pressure air supply system constructed in accordance with said second aspect connected to the booster so as to provide a supply of low pressure air to the air compressor of the booster.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
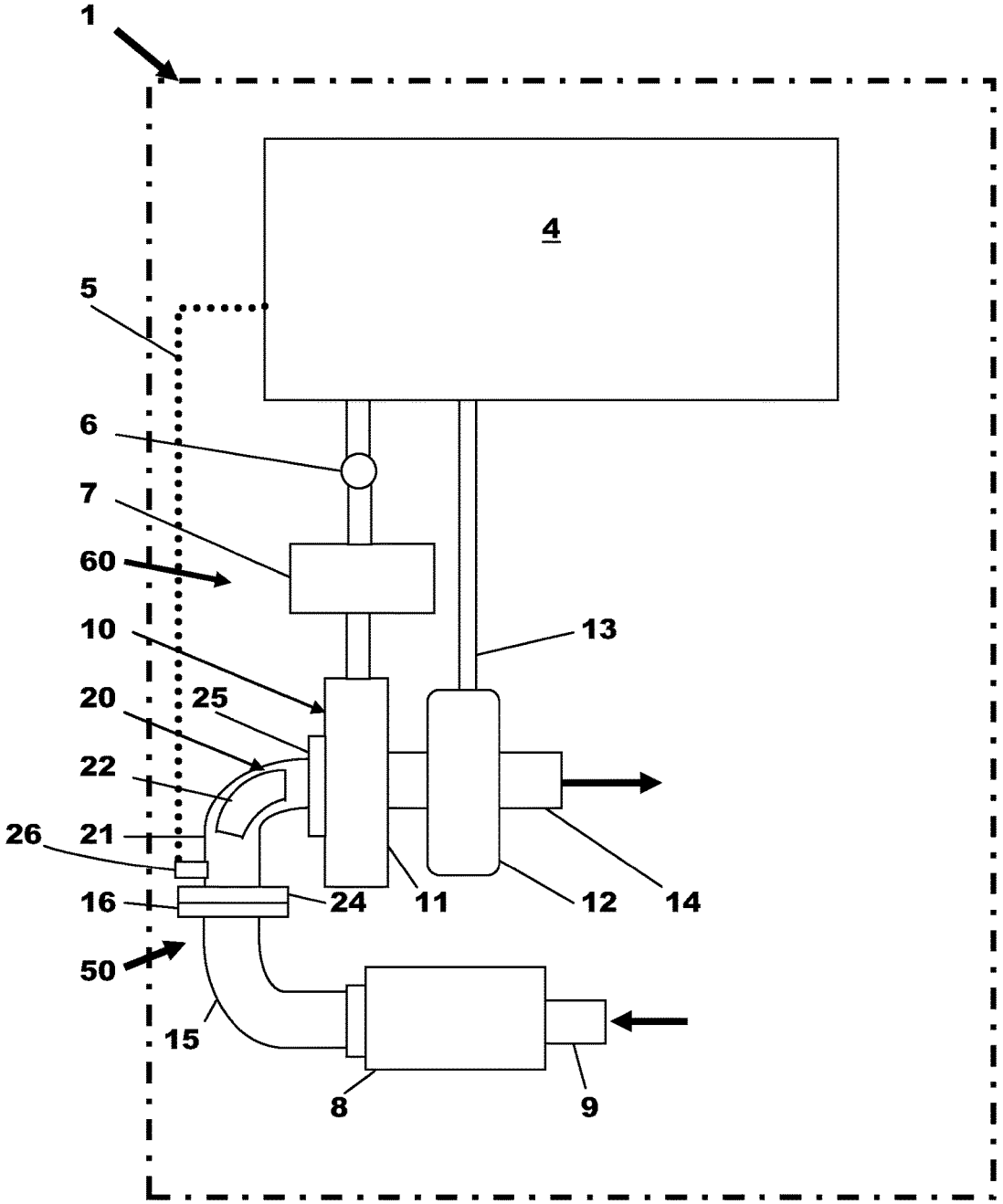
FIG. 1 is a schematic representation of a motor vehicle having a low pressure air supply system including an acoustic attenuator according to one aspect.
Figure 2:
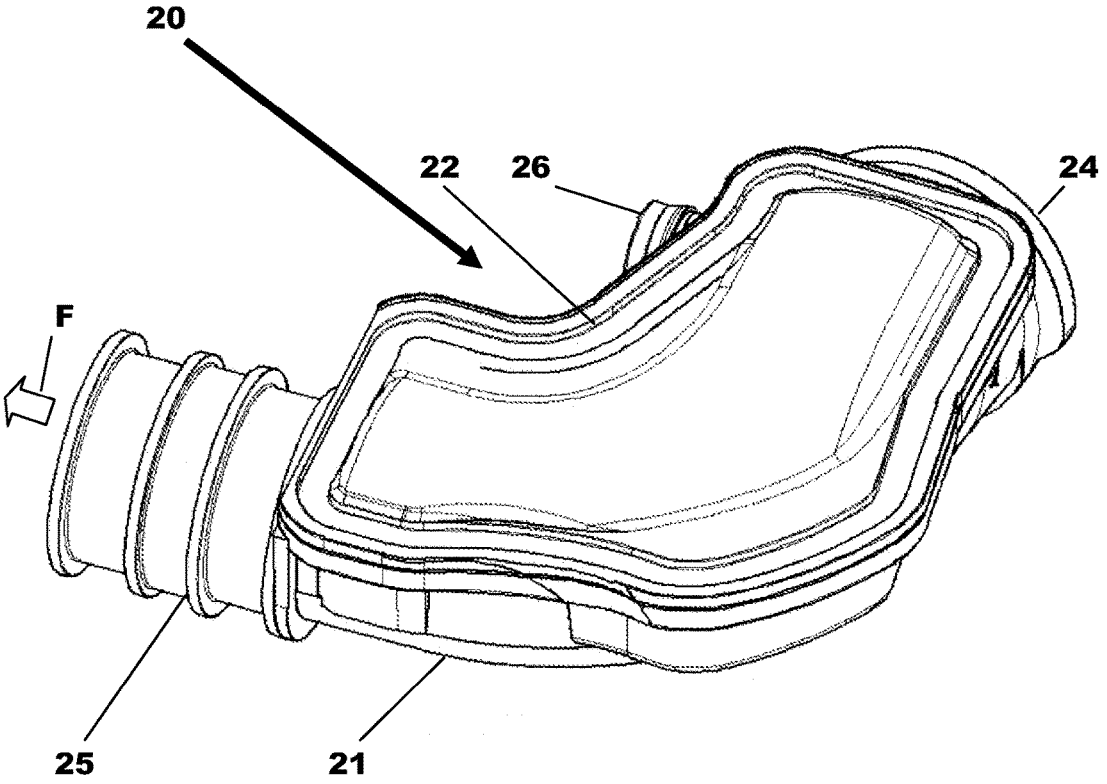
FIG. 2 is a pictorial representation of a preferred embodiment of an acoustic attenuator according to one aspect showing the acoustic attenuator in a fully assembled condition.
Figure 3:
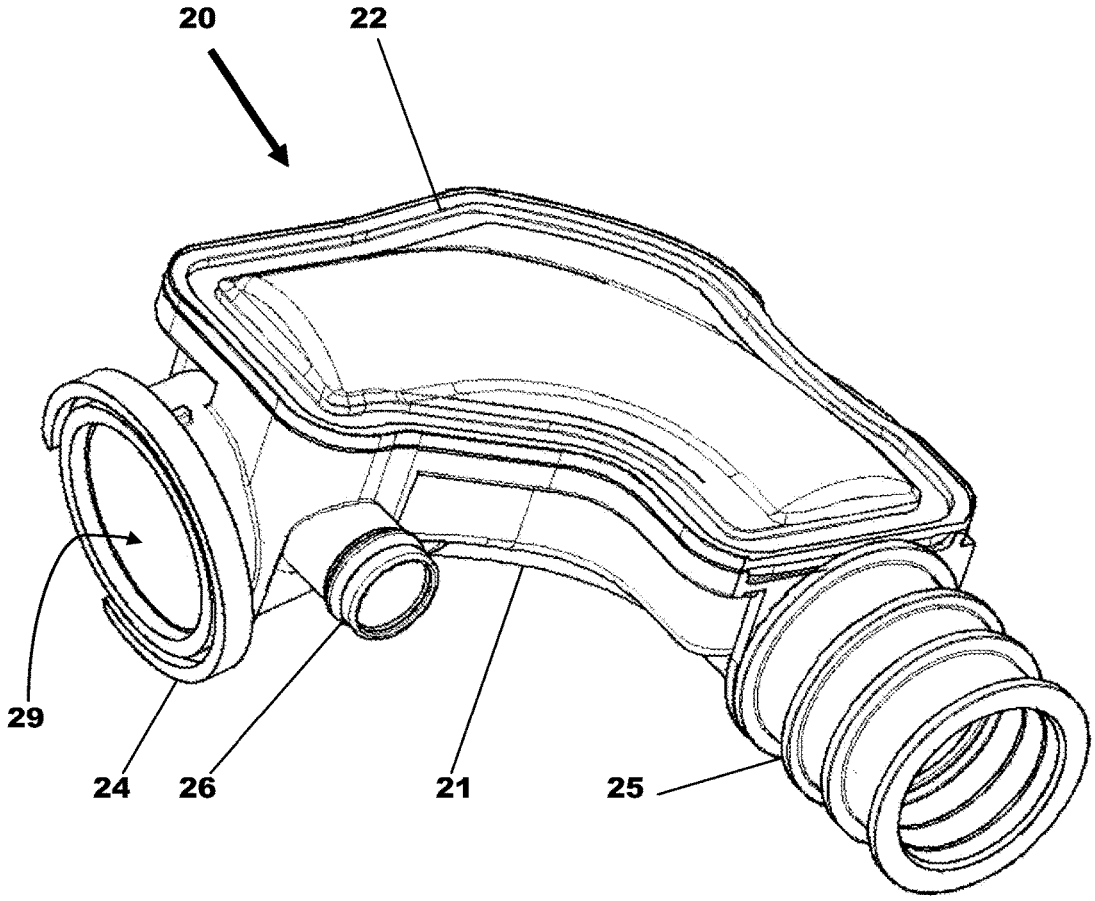
FIG. 3 is a pictorial representation similar to that shown in FIG. 2 but from a reverse angle.
Figure 4:
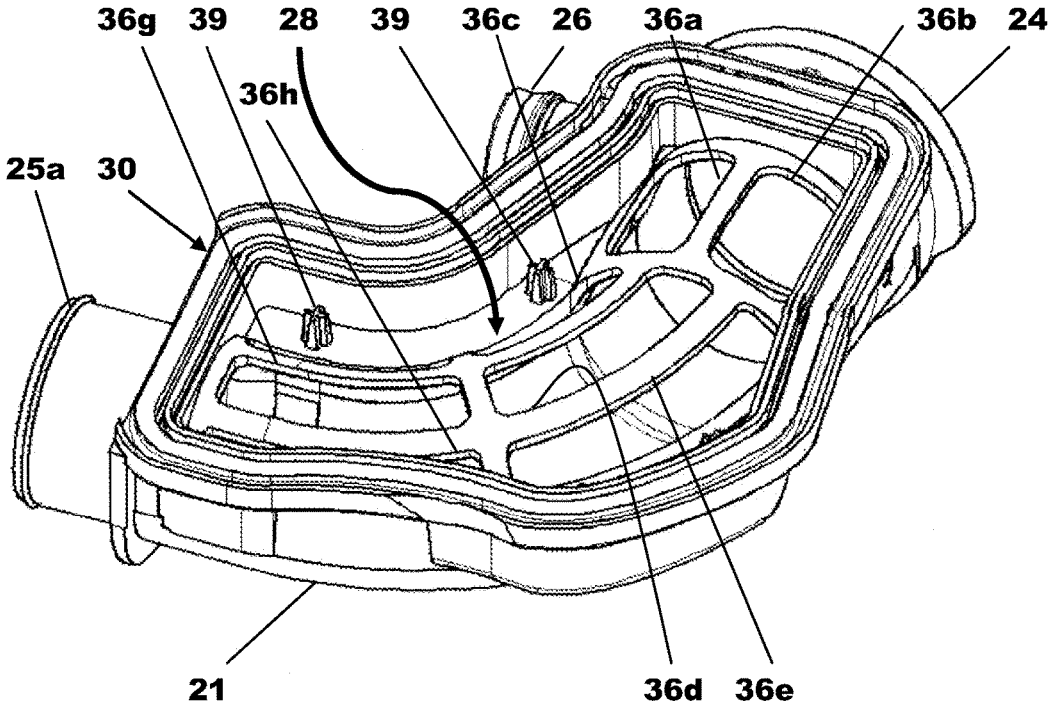
FIG. 4 is a view similar to that shown in FIG. 2 but with a cover removed so as to show an attenuator housing in position within a body of the acoustic attenuator prior to the filling of an attenuator chamber defined by the attenuator housing with a vibration absorbing material.
Figure 5:
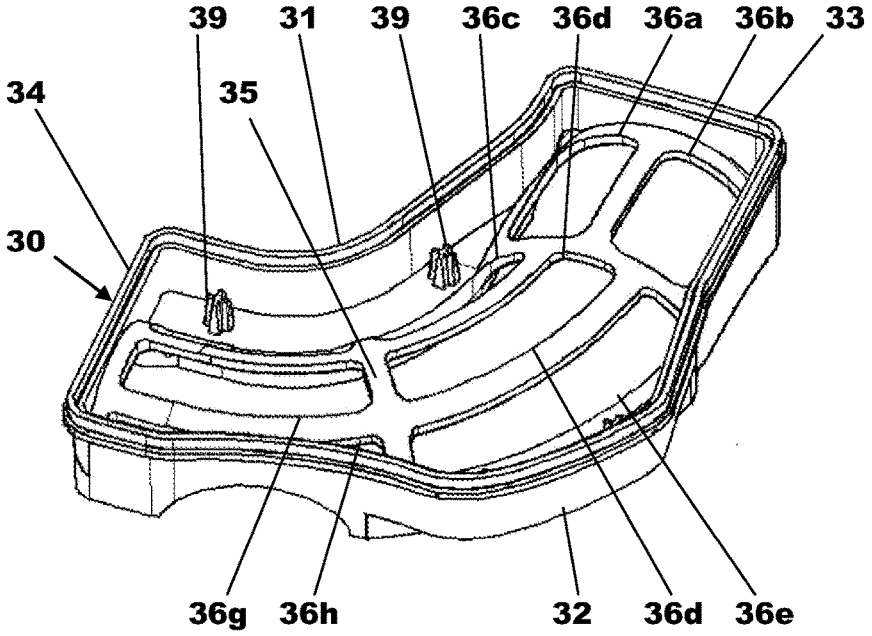
FIG. 5 is a pictorial view of the attenuator housing shown in FIG. 4 with the attenuator body material removed so as to show the detail of the attenuator housing.
Figure 6:
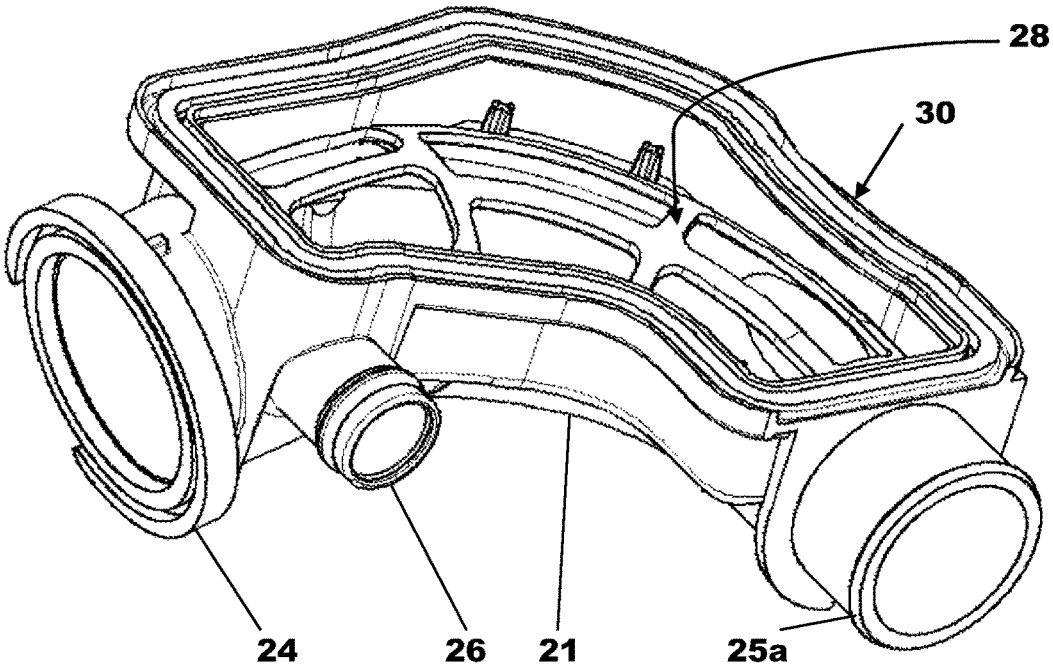
FIG. 6 is a view similar to that shown in FIG. 3 but with a cover removed so as to show an attenuator housing in position within a body of the acoustic attenuator prior to the filling of an attenuator chamber defined by the attenuator housing with a vibration absorbing material.
Figure 7:
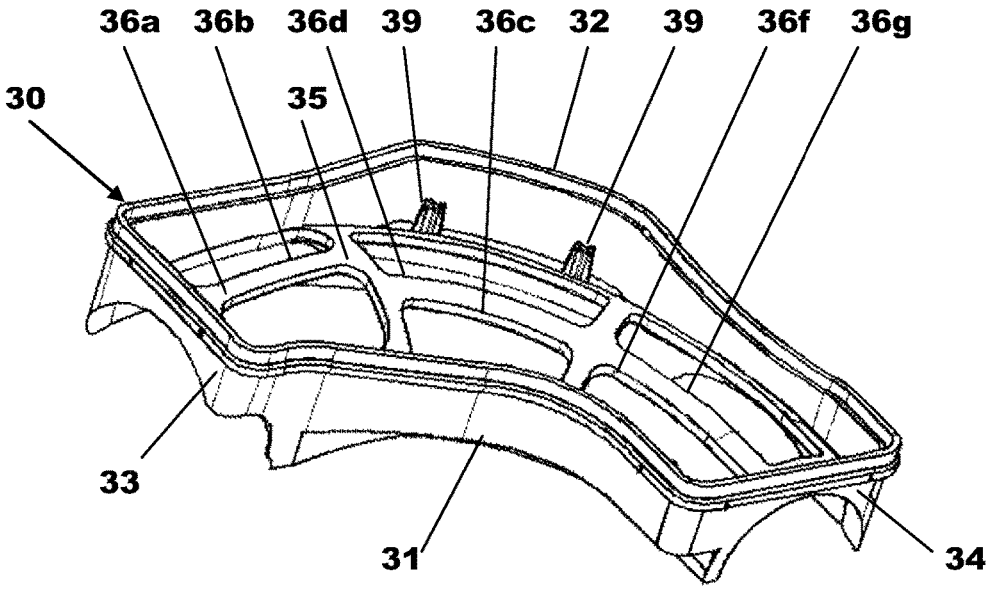
FIG. 7 is a pictorial view of the attenuator housing shown in FIG. 6 with the attenuator body material removed so as to show the detail of the attenuator housing.

Referring now to FIG. 1, there is shown a motor vehicle 1 having an engine 4 and a booster in the form of a turbocharger 10 to provide a supply of boosted air to the engine 4. The turbocharger 10 includes an air compressor 11 in which is rotationally mounted an air compressor rotor (not shown) and a turbine 12 in which is rotationally mounted an exhaust gas rotor (not shown). Exhaust gases flow from the engine 4 via an exhaust conduit 13 to the turbine 12 where it causes rotation of the turbine rotor before exiting to atmosphere via an exhaust system 14 which may include one or more emission control devices (not shown).

The rotation of the turbine rotor causes a corresponding rotation of the air compressor rotor because the two are driveably connected by a drive shaft (not shown). The rotation of the air compressor rotor causes air to be drawn in via a low pressure air supply system 50, compressed and then supplied to the engine via a high pressure or boosted air supply system 60. The high pressure air supply system 60 includes, in this case, a charge intercooler 7 to cool the air and a throttle valve 6 to control the flow of air and various conduits joining the engine 4 to an outlet port from the air compressor 11. The low pressure air supply system 50 comprises a low pressure air inlet 9 through which atmospheric air is drawn into the system, an air filter 8 for filtering the air drawn in via the low pressure air inlet 9 and a low pressure air conduit 15 connecting the air filter 8 to an inlet end of an acoustic attenuator 20.

The acoustic attenuator 20 has an attenuator body 21 defining an air supply conduit or air flow passage through which low pressure air flows to the air compressor of the turbocharger 10. An attenuator chamber (not shown in FIG. 1) is covered by a cover 22 fixed to the attenuator body 21. The attenuator chamber can be formed as part of the attenuator body or as a separate component that is assembled to the attenuator body 21. In either case, the attenuator chamber is operatively connected to the air flow passage by a number of elongate apertures which form transfer ports (not shown in FIG. 1) and contains an acoustic pressure wave absorbing material in the form of a fibrous mat or pad, a pad of a plastic foam material, or a combination of plastic foam and fibrous mat. The density of the absorbing material is chosen to dampen acoustic pressure waves of a specific range of frequencies corresponding to the expected undesirable frequencies produced by the turbocharger 10 during use such as 'chirp' and 'whoosh' noises.

The acoustic attenuator 20 is located close to an inlet port of the air compressor 11. In one example, the acoustic attenuator may be adjacent to the inlet of the air compressor, with nothing in between the two parts. In another example, the acoustic attenuator may be separated from the inlet port of the air compressor by another part (e.g., spacer, adaptor, or tube section). In either case, the distance between the acoustic attenuator and inlet port of the air compressor may be within a threshold distance such that acoustic pressure waves may be attenuated. The acoustic attenuator body 21 may be adapted at an outlet end for connection to an inlet port of the air compressor (compressor) 11 of the turbocharger 10. The attenuator body may be adapted for direct connection to the inlet port of the air compressor or may be adapted for indirect connection by being connected via a short spacer component such as a tube.

The acoustic attenuator body 21 may be connected to the inlet port of the air compressor by, in this case, the use of a flexible pipe (flange) 25 that may be secured to the air compressor 11 by means of a number of threaded fasteners (not shown). However, other means of connection could be used. The acoustic attenuator body 21 is adapted at an inlet end for connection to the low pressure air conduit 15 by, in this case, the use of a flange 24 that is secured to a complementary flange 16 formed on a cooperating end of the low pressure air conduit 15 by means of a number of threaded fasteners (not shown) but other means of connection could be used.

Air flows into the low pressure air inlet 9, through the air filter 8 and the low pressure air conduit 15, to the acoustic attenuator 20, and then into the air compressor 11 where it is compressed and flows to the engine 4 via the high pressure air supply system 60. When flow disturbances occur in the air compressor 11 due to backflow, surge, or other effects, acoustic pressure waves are created which radiate back from the air compressor into the low pressure air supply system 50. However, because the acoustic attenuator 20 is directly connected to the inlet port of the air compressor 11, the magnitude of these vibrations is significantly attenuated by their interaction with the acoustic pressure wave absorbing material housed in the attenuator chamber soon after they exit the air compressor 11. In this way, adverse effects on the flow of air to the air compressor of the turbocharger 10 are reduced and the radiation of noise from other components of the low pressure air supply system 50 located upstream from the acoustic attenuator 20 are minimized.

It will be appreciated by those skilled in the art that the noise radiated or projected is based not only on the magnitude of the acoustic pressure waves but also on the surface area from which these vibrations are radiated. Therefore, by close coupling of the acoustic attenuator 20 to the turbocharger 10, the surface area of the low pressure air supply system 50 exposed to high magnitude acoustic pressure waves is significantly reduced. Thus, the audible noise that can be heard by a person in close proximity to the turbocharger 10, such as for example a driver or passenger of the motor vehicle 1, may be reduced.

It will be appreciated that the frequencies that can be attenuated by the acoustic absorptive material will be dependent upon many factors, including the nature of the material from which the absorptive material is manufactured. In general, the internal structure, surface openings, flow resistance, thickness, and density may influence attenuation frequencies. The combined effects of these properties determine the acoustic impedance (absorption coefficient) of a given material. Compression of the material into a more dense structure increases the density and flow resistivity, which in turn improves the low-frequency absorption for a given thickness.

The density used can be that of the absorption material in the free state, that is to say, the volume of the attenuating chamber is the same as or greater than the volume of the absorption material in its free state. Alternatively, the density of the absorptive material can be increased from its free density by using an attenuator chamber having a smaller volume than the free volume of the absorptive material.

It will also be appreciated that the attenuator chamber may include absorbing material having different acoustic pressure wave absorbing properties. That is to say, it could have two or more different materials or the same material in which the density of the material is different. In this way, the acoustic attenuator can be arranged to attenuate several undesirable ranges of acoustic pressure wave. For example, the attenuator chamber could be filled with a low density fibrous mat covered in a layer of higher density plastic foam.

Referring back to FIG. 1, the engine 4 includes a positive crankcase breather system including a breather conduit 5 (shown as a dotted line on FIG. 1) that is connected to the low pressure air supply system 50 at a position upstream from the attenuator chamber by means of a crankcase breather connector 26. It will be appreciated by those skilled in the art that the flow through such a crankcase breather system comprises air with entrained oil.

Figure 10:
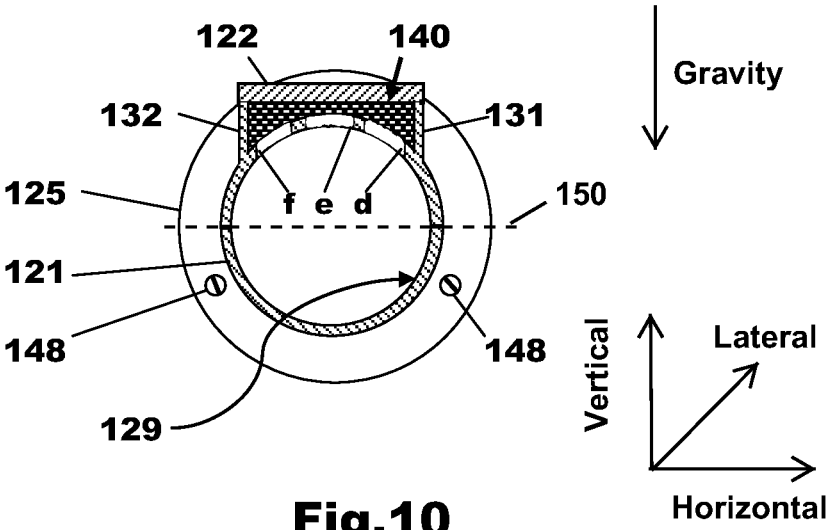
FIG. 10 is a cross-section on the line X-X on FIG. 9.

The wheels of vehicle 1 may sit (or rest) on a surface such that gravity is defined in a vertical direction, toward the surface. FIG. 10 displays axes showing the direction of gravity in a downward (negative) vertical direction. This figure shows a lateral cross-section of air flow passage 129, such that air flow is traveling in the lateral direction. Dividing line 150 divides the air flow passage 129 and attenuator body 121, in a horizontal direction, into an upper (above dividing line 150) and lower (below dividing line 150) portion or half. Though FIG. 10 shows a second embodiment of the acoustic attenuator, the directions as described above may be the same for the first embodiment of the acoustic attenuator. FIG. 10 will be described in further detail below.

Thus, since gravity is in a downward vertical direction when a vehicle is traveling on level surface, entrained oil may pool at the bottom, or lower portion, of any air flow conduits or passages. These bottom or lower portions may be the portions of the conduits or passages which are closest to the surface that the vehicle 1 sits on. The opposing portion of the air flow conduits/passages and engine components (attenuator body) may be the upper portion. Thus, the upper portion may be the portion of the components further from the surface on which the vehicle sits. In this way, an upper portion of the attenuator body (or other conduits/passages) may be an upper portion in a vertical direction relative to the surface on which the wheels of vehicle 1 rest.

It is advantageous to use an attenuator chamber that extends around only an upper portion of the attenuator body because oil contamination of the absorbing material contained within the attenuator chamber is reduced. It will be appreciated that oil contamination of the absorbing material will result in the attenuating properties of the absorbing material being altered or in some cases lost. If the attenuator chamber extends around the entire periphery of the attenuator body, oil can collect or pool in the attenuator chamber located in the lower half of the attenuator body, thereby contaminating the absorbing material. Furthermore, any such collected oil may also in certain conditions be drawn into the air compressor 11, thereby causing damage to the rotor of the air compressor 11 and unacceptable emissions from the engine 4.

In other embodiments, the attenuator chamber may extend around another portion of the attenuator body other than the upper portion such as, for example, a side portion or a lower portion. It will be appreciated by those skilled in the art that it is advantageous to use an attenuator chamber that extends around only a portion of the attenuator body, irrespective of its orientation, because any pressure loss due to the presence of the attenuator chamber will be reduced if the attenuator chamber extends only partially around the periphery of the attenuator body compared to the situation where the attenuator chamber extends around the entire periphery of the attenuator body.

Referring now to FIGS. 2 to 8, there is shown a preferred embodiment of the acoustic attenuator 20 shown diagrammatically in FIG. 1. FIGS. 2 through 8 are drawn to scale. The acoustic attenuator 20 comprises a plastic attenuator body 21 defining an elbow shaped air flow passage 29 through which low pressure air flows, as described above. A plastic cover 22 is, in this case, vibration welded to the attenuator body 21 to provide a lid for an attenuator chamber 28, defined by the cover 22 and an attenuator housing 30. It will be appreciated that other means for securing the plastic cover 22 to the attenuator body 21 could be used and that the securing is not limited to the use of vibration welding.

The attenuator body 21 is adapted at an inlet end by means of a flange 24 for connection to an upstream portion of the air supply system 50 (such as low pressure air supply conduit 15 via complementary flange 16, as shown in FIG. 1) and is adapted at an outlet end by means of a hollow spigot 25*a* and flexible pipe, or flange, 25 for connection to an inlet port of the air compressor 11 of the turbocharger 10. The air compressor 11 has a hollow spigot similar to the hollow spigot 25*a* which engages with the flexible pipe 25 to connect the attenuator body 21 to the inlet port of the air compressor 11.

The attenuator body 21 also has a crankcase ventilation system return connector, crankcase breather connector 26, formed as an integral part thereof in the form of a pipe. The attenuator body 21 defines a cavity into which the attenuator housing 30 is fitted and secured in place along with the plastic cover 22 by vibration welding in a single operation. A number of fir tree connectors 39 extend from a floor 35 of the attenuator housing 30. The connectors 39 are used to fasten the acoustic absorbing material within the attenuator housing 30.

The attenuator housing 30 is formed from a plastic material by a molding process and comprises the floor 35, a first upstream end wall 33, a second downstream end wall 34, a first or inner side wall 31, and a second or outer side wall 32. The floor 35 includes, in this case, eight, spaced apart, elongate apertures (apertures) 36*a* to 36*h*. Each of these elongate apertures form a transfer port for the transfer of acoustic pressure waves from the air flow passage 29 to the attenuator chamber 28 during operation of the turbocharger 10. That is to say, acoustic pressure waves radiating in a backflow direction from the inlet port of the air compressor 11 enter the attenuator chamber 28 via the transfer ports formed by the elongate apertures 36*a* to 36*h*. The shape and size of the apertures 36*a* to 36*h* are optimized to reduce the disruption of the flow into the air compressor 11, while providing sufficient interaction between the air flow passage 29 and acoustic pressure wave absorbing material, located in the attenuator chamber 28, to provide good vibration attenuation.

The width of the attenuator chamber 28 and the location of the elongate apertures along the length of the air flow passage 29 may influence one or more of the size, number, and shape of the elongate apertures. The shape and size of apertures 36*a* to 36*h* may vary amongst each other. The size and shape of each aperture may depend on the size and shape of attenuator body 21, and resulting air flow passage 29. For example, the elbow shaped air flow passage 29 may alter the width of the of the attenuator chamber, resulting in a narrower width at the first upstream end wall 33 and second downstream end wall 34 of the attenuator housing 30 than in the middle of the attenuator chamber 28. The width of the attenuator housing and chamber may be defined as the width in the horizontal direction, perpendicular to the direction of air flow through air flow passage 29 and parallel to the plastic cover 22 and end walls (first upstream end wall 33 and second downstream end wall 34). As such, the widest portion of the attenuator housing and chamber may be at the curve of the elbow. Thus, a larger number of apertures may be located in the floor 35 at the curved portion of the elbow. This may be more clearly seen in FIG. 8 which provides a top-down view of the attenuator housing 30. This top-down view shows the attenuator housing 30 and attenuator chamber 28 which may be in an upper (or top) portion of attenuator body 21. Thus, gravity, defined as being in the vertical direction toward the surface on which the vehicle's wheels sit, is in the direction into the page of FIG. 8.

Figure 8:
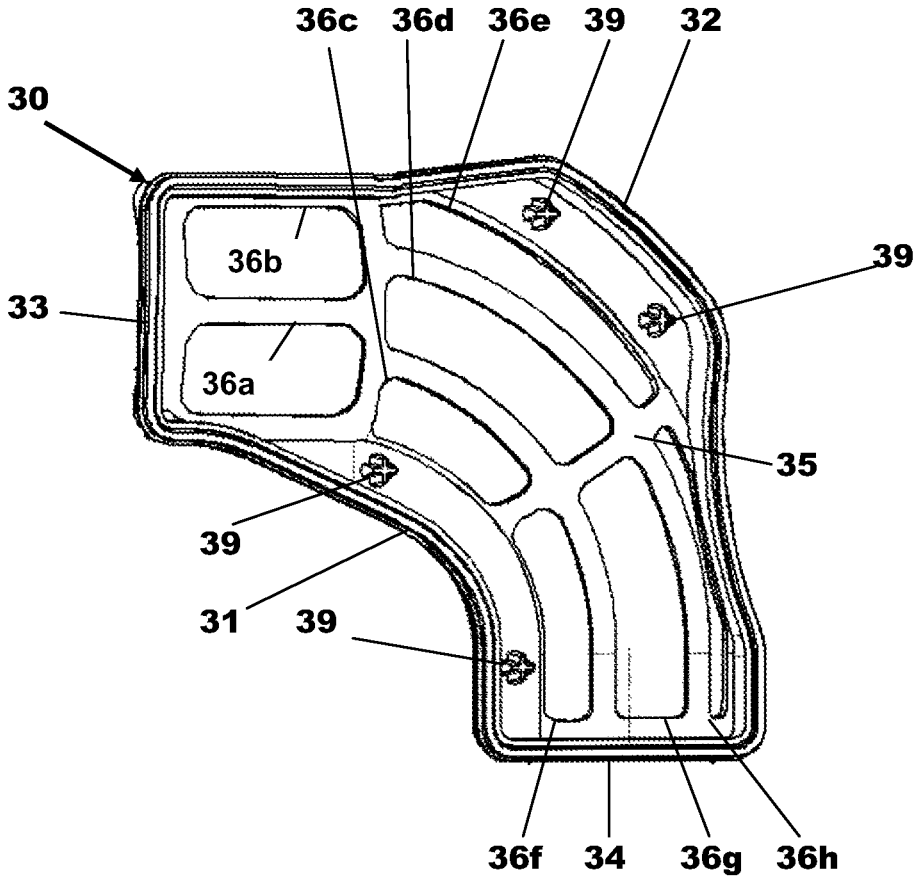
FIG. 8 is a plan view of the attenuator body prior to insertion of the attenuator housing into the attenuator body.

As seen in FIG. 8, three apertures (apertures 36*c*, 36*d*, and 36*e*) may be located in the wider, curved portion of the elbow. The number and size of apertures may also be different at the first upstream end wall 33 (inlet end) and second downstream end wall 34 (outlet end). For example, there may be fewer apertures (two in this example—apertures 36*a* and 36*b*) nearest the first upstream end wall 33 than nearest the second downstream end wall 34 (three in this example). The fewer apertures at the inlet end may also be wider, in the direction parallel to the end walls (33 and 34), than the apertures across the middle or outlet end of the attenuator body 21.

The overall shape of the apertures 36*a*-36*h* may be rectangular with curved corners (as in apertures 36*a* and 36*b*). The apertures are described as elongate apertures, as they have a longer length, with respect to the direction of the air flow path, than width (in direction parallel to end walls and perpendicular to the air flow path). The location of the apertures, with respect to the inlet or outlet end of the attenuator body 21, may influence the aperture width. For example, apertures 36*a* and 36*b*, located near the inlet end (near flange 24), may have a larger width, in the direction parallel to the first upstream end wall, than apertures in the middle or near the outlet end of the attenuator body 21. Further, the edges of the apertures may either be straight or curved. Several edges may be curved to follow the elbow shape of the floor 35, attenuator body 21, and air flow passage 29. This may be seen in apertures 36*c*-36*h*, wherein the long edges parallel to the air flow path along the air flow passage, curve along with the shape of floor 35. In this way, the long edges, parallel to the air flow path along the air flow passage, of the elongate apertures at the middle and outlet end of the air flow passage may be curved to follow the elbow shape of the air flow passage.

The length of the apertures may also differ depending on their location relative to the walls of the attenuator housing 30. For example, apertures 36*a* and 36*b*, near first upstream end wall 33, may have a shorter length (direction as described above) than some of the downstream apertures (e.g., 36*e* and 36*g*). Further, the apertures nearest inner side wall 31 (along inner curve of elbow) may have a shorter length than the apertures nearest the outer side wall 32 (along outer curve of elbow). For example, in FIG. 8, aperture 36*c* may have a shorter length than aperture 36*e*. In this way, aperture length may increase from the inner side wall to the outer side wall of the attenuator housing.

The location of the apertures with relation to each other may be chosen based on optimized vibration attenuation, interaction between the air flow passage 29 and acoustic pressure wave absorbing material, and flow through the air flow passage 29 into air compressor 11. For example, the spacing between apertures may be chosen to increase or decrease the interaction between the air flow passage 29 and the acoustic pressure wave absorbing material. In one example, the spacing may be small such that the floor 35 has a small material surface area (area without voids/transfer ports). This may increase the interaction between the air flow passage and acoustic pressure wave absorbing material, increasing acoustic attenuation. This may also increase the overall area of the apertures and transfer ports. Further, the apertures may be spaced so that they are either in line or offset from one another. In one example, apertures may be spaced offset from one another, such that their long edges (edges in the direction parallel to air flow through air flow passage 29) are not in line with each other. For example, apertures 36*a* and 36*b* are offset from apertures 36*c*-36*e*. However, apertures 36*c*-36*e* are in line with apertures 36*f*-36*h*.

In this way, the size, shape, and location of each aperture may be changed depending on the size and shape of the air flow passage 29 and attenuator chamber 28. These variables may also change depending on the acoustic attenuation needs. Further, the location of the apertures in relation to each other may also be altered. It will also be appreciated that the total number of apertures, as well as the number of apertures in specific areas of the floor 35 and attenuator housing, is selected depending upon optimization for various attributes in different scenarios, e.g. pressure loss and flow characteristics, surface area for attenuation and structural rigidity/robustness and that the attenuator is not limited to the use of eight apertures.

The acoustic pressure wave absorbing material may be in the form of a fiber mat, a polymer foam pad, or a combination of the two, such as a foam coated fiber mat. The composition and density of the absorbing material is chosen based upon the frequency range to be attenuated. It will, however, be appreciated that such material is able to attenuate a broad band or range of frequencies and is not limited to the attenuation of a specific frequency. The exact material selected is based upon experimental work to establish the frequency range that needs to be attenuated for the particular turbocharger and low pressure air supply system configuration.

One advantage of the use of an elbow shaped air flow passage 29 is that line of sight propagation which can occur at frequencies approximately 7 times smaller than the transverse dimension of the air flow passage 29 is reduced.

It will be appreciated that, while the main mechanism for attenuating the noise generated by the air compressor is the use of a dissipative acoustic attenuation material, there will also be some reactive attenuation due to the interaction of the vibrations with the attenuator chamber 28.

It will also be appreciated that the air compressor 11 could also be an air compressor of a supercharger and that the attenuator is not limited to use with a turbocharger. The term 'booster' as meant herein therefore includes both a turbocharger and a supercharger.

Figure 9:
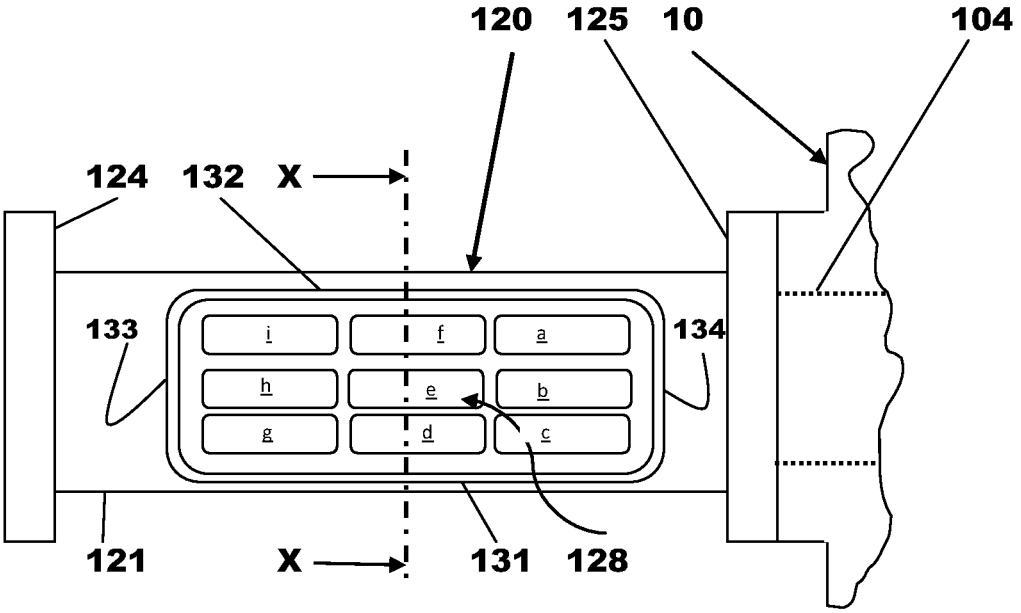
FIG. 9 is a plan view of a second embodiment of acoustic attenuator attached to an inlet port of a turbocharger.

Referring now to FIGS. 9 and 10, there is shown a second embodiment of acoustic attenuator 120 that is intended to be a direct replacement for the acoustic attenuator 20 shown in FIG. 1. FIGS. 9 and 10 are drawn to scale. In this case, the acoustic attenuator 120 is formed of a linear component whereas, in the preferred embodiment it is shown as an elbow shaped component for the reason stated above. It will, however, be appreciated that, in practice, the shape of the acoustic attenuator may be dictated by a desired flow path for the low pressure air supply system 50 to meet packaging constraints. As such, other shapes apart from those shown could be used.

The acoustic attenuator 120 includes an attenuator body 121, defining an attenuator chamber 128 which, in this case, is formed as part of the attenuator body 121, and an air flow passage 129 through which low pressure air flows through, as described above. The attenuator body 121 is formed as two separate plastic components which are, in this case, vibration welded together. However, other means for securing the two parts together could be used. One of the plastic components forms the lower half of the air flow passage 129 and the other forms the upper half of the air flow passage 129, which includes the attenuator chamber 128. Referring to FIG. 10, the lower half of the air flow passage 129 is below dividing line 150, while the upper half of the air flow passage 129 is above dividing line 150. The attenuator chamber 128 may be located in the upper half of the attenuator body 121 and air flow passage 129. As discussed above, dividing line 150 is in a horizontal direction, air flows through air flow passage 129 in a lateral direction, and gravity is defined in a downward vertical direction. Thus, any entrained oil within air flow passage 129 may sit in the lower half of the air flow passage.

A plastic cover 122 is, in this case, vibration welded to the attenuator body 121 to provide a lid for the attenuator chamber 128, which is defined by the cover 122 and four walls 133, 134, 131 and 132, formed as an integral part of the upper half of the attenuator body 121. It will be appreciated that other means could be used to secure the cover 122 to the body 121 and that the method of securing is not limited to the use of vibration welding.

The attenuator body 121 is adapted at an inlet end by means of a flange 124, vibration welded to the end of the attenuator body 121 for connection to an upstream portion of the air supply system. Attenuator body 121 is further adapted at an outlet end by means of a flange 125, vibration welded to the end of the attenuator body 121 for connection to an inlet port 104 of the turbocharger 10. Three screws 148, of which only two are visible, are used in this case to secure the flange 125 to the turbocharger 10. However, it will be appreciated that other means could be used to secure the flange 125 to the turbocharger 10. A crankcase ventilation system return connector could also be formed as an integral part of the attenuator body 121, in some embodiments.

Nine apertures a, b, c, d, e, f, g, h and i are formed in the attenuator body 121 and define transfer ports connecting the attenuator chamber 128 to the air flow passage 129. As before, the transfer ports defined by the apertures a, b, c, d, e, f, g, h and i allow acoustic pressure waves to enter the attenuator chamber 128 and interact with an acoustic pressure wave absorbing material 140 located in the attenuating chamber 128, thereby attenuating these vibrations by a dissipative process. The magnitude of vibrations upstream from the attenuator chamber 128 is thereby reduced.

As described above, the size of these apertures may be altered depending on the desired acoustic attenuation properties. However, in this embodiment, the apertures may be the same size in relation to one another. Further, the spacing between the apertures may be similar and the apertures may all be in line with one another (not offset). In this embodiment, the edges of the apertures may be straight, as air flow passage 129 and attenuator body 121 are linear (not curved in an elbow shape as in the first embodiment).

Also as described above, the acoustic pressure wave absorbing material 140 can be in the form of a fiber mat, a polymer (plastic) foam pad or a combination of the two such as a foam coated fiber mat. The composition and density of the absorbing material is, as before, chosen based upon the frequency range to be attenuated.

Therefore in summary, an attenuator for an air compressor of an engine booster is provided that is of a compact design and is economical to manufacture. The attenuator can be readily adapted for use on various engine configurations by changing the properties of the acoustic pressure wave absorbing material used in the attenuator chamber. It attenuates air path noises in the frequency range between 1 kHz and 12 kHz that radiate from the air induction system components and the air compressor inlet port, generated during spooling and running, as well as tip out maneuvers, without the cost and complexity of air compressor bypass valves or multiple resonator chambers.

It will be appreciated that the term 'adapted for connection to an inlet port of the air compressor' includes both direct connection of the acoustic attenuator and connection via a connector such as a short piece of pipe or tube.

It will be appreciated by those skilled in the art that although the subject matter of this disclosure has been described by way of example with reference to one or more embodiments it is not limited to the disclosed embodiments and that alternative embodiments could be constructed without departing from the scope of disclosed subject matter as defined by the appended claims.

The invention claimed is:

1. A vehicle, comprising:

an engine;

an engine booster comprising an air compressor;

an attenuator body defining an air flow passage having an elbow shape through which low pressure air flows to the air compressor, an outlet end of the air flow passage adjacent to and directly connected with an inlet port of the air compressor, with nothing in between the attenuator body and the inlet port of the air compressor, wherein the attenuator body comprises a crankcase breather connector that receives air entrained with oil;

a single attenuator chamber containing acoustic pressure wave absorbing material operatively connected to the air flow passage via a number of transfer ports, wherein the single attenuator chamber is positioned downstream of the crankcase breather connector, wherein each transfer port is formed by an elongate aperture, and wherein the single attenuator chamber extends around only an upper portion, in a vertical direction relative to a surface on which a wheel of the vehicle rests, of the attenuator body; and a vibration-welded cover secured to a top of the single attenuator body, above tree connectors on both an inner and outer curve of the elbow, so as to form a lid.

2. The vehicle as claimed in claim 1, wherein each elongate aperture is aligned with a general flow path of air through the air flow passage.

3. The vehicle as claimed in claim 1, wherein the acoustic pressure wave absorbing material is one of a fibrous mat, foam, and a combination of foam and a fibrous mat.

4. The vehicle as claimed in claim 3, wherein the attenuator chamber houses at least two acoustic pressure wave absorbing materials having differing frequency absorbing properties.

5. The vehicle as claimed in claim 1, wherein the attenuator chamber is formed by a separate attenuator housing that fits in an aperture in the attenuator body.

6. The vehicle as claimed in claim 5, wherein the attenuator housing comprises first and second end walls, first and second side walls, and a floor in which the transfer ports are formed.

7. An acoustic attenuator for an engine booster of a vehicle, comprising:

an attenuator body, including an air flow passage having an elbow shape through which low pressure air flows from an inlet end of the attenuator body, connected to a low pressure air conduit, to an outlet end of the attenuator body, the outlet end adjacent to and directly connected to an air compressor, with nothing in between the attenuator body and the air compressor, wherein the attenuator body comprises a crankcase breather connector that receives air entrained with oil;

a single attenuator chamber, connected to the air flow passage by a number of elongate apertures which form a number of transfer ports for transfer of acoustic pressure waves from the air flow passage to the attenuator chamber, including an acoustic pressure wave absorbing material for absorbing the acoustic pressure waves, and formed by an attenuator housing, wherein the single attenuator chamber is positioned downstream of the crankcase breather connector, and wherein the single attenuator chamber extends around only an upper portion, in a vertical direction relative to a surface on which a wheel of the vehicle rests, of the attenuator body; and a vibration-welded cover secured to a top of the single attenuator body, above tree connectors on both an inner and outer curve of the elbow extending from a floor of the attenuator body, so as to form a lid.

8. The acoustic attenuator as claimed in claim 7, wherein the elbow shape of the air flow passage alters a width of the attenuator chamber, in a horizontal direction, along a length of the air flow passage.

9. The acoustic attenuator as claimed in claim 8, wherein the width of the attenuator chamber and a location of the elongate apertures along the length of the air flow passage influences one or more of a size, a number, and a shape of the elongate apertures.

10. The acoustic attenuator as claimed in claim 9, wherein the location of the elongate apertures includes each of an inlet end, a middle, and an outlet end of the air flow passage.

11. The acoustic attenuator as claimed in claim 10, wherein the number of elongate apertures is greater at the middle and the outlet end of the air flow passage.

12. The acoustic attenuator as claimed in claim 10, wherein a width, in a direction parallel to a first upstream end wall, of the elongate apertures is larger at the inlet end of the air flow passage.

13. The acoustic attenuator as claimed in claim 8, wherein a length, in a direction of air flow along the air flow passage, of the elongate apertures increases from an inner side wall to an outer side wall of the attenuator housing.

14. The acoustic attenuator as claimed in claim 10, wherein long edges, parallel to an air flow path along the air flow passage, of the elongate apertures at the middle and outlet end of the air flow passage are curved to follow the elbow shape of the air flow passage.

* * * * *